US006345480B1

(12) United States Patent
Kemper et al.

(10) Patent No.: US 6,345,480 B1
(45) Date of Patent: Feb. 12, 2002

(54) BRIDGING ARRANGEMENT

(75) Inventors: Hans A. Kemper, Kierspe; Frank Sondermann, Frenkhausen, both of (DE)

(73) Assignee: Hermann Friedrich Kunne GmbH & Co. (DE)

( * ) Notice: Subject to any disclaimer, the term of this patent is extended or adjusted under 35 U.S.C. 154(b) by 0 days.

(21) Appl. No.: 09/446,941

(22) PCT Filed: Jun. 30, 1998

(86) PCT No.: PCT/EP98/03991

§ 371 Date: Mar. 27, 2000

§ 102(e) Date: Mar. 27, 2000

(87) PCT Pub. No.: WO99/01628

PCT Pub. Date: Jan. 14, 1999

(30) Foreign Application Priority Data

Jul. 2, 1997 (DE) ..... 297 11 606 U

(51) Int. Cl.[7] ..... E04B 1/68

(52) U.S. Cl. ..... 52/395; 52/273; 52/396.04; 52/396.08; 52/396.1; 52/402; 52/466; 52/468; 52/288.1; 52/718.02; 52/718.05; 52/718.06; 52/717.03; 52/717.05; 49/480.1; 49/482.1; 403/118

(58) Field of Search ..... 52/126.1–126.7, 52/273, 287.1, 288.1, 395, 402, 466, 468, 471, 717.01, 717.04, 717.06, 718.02, 718.03, 718.05, 718.06, 396.04, 396.08, 396.1; 403/118; 49/466–468, 469, 482.1, 480.1

(56) References Cited

U.S. PATENT DOCUMENTS

| | | | | |
|---|---|---|---|---|
| 3,381,436 A | * | 5/1968 | Elliott et al. | |
| 3,696,575 A | | 10/1972 | Armstrong | |
| 4,067,155 A | * | 1/1978 | Ruff et al. | 52/105 |
| 4,736,563 A | * | 4/1988 | Bilhorn | 52/460 |
| 5,155,952 A | * | 10/1992 | Herwegh et al. | 52/100 |
| 5,353,571 A | * | 10/1994 | Berdan et al. | 52/716.5 |
| 5,657,598 A | * | 8/1997 | Wilbs et al. | 52/287.1 |

FOREIGN PATENT DOCUMENTS

| | | |
|---|---|---|
| DE | 9600057 U | 4/1986 |
| DE | 3507494 A | 9/1986 |

* cited by examiner

*Primary Examiner*—Yvonne M. Horton
(74) *Attorney, Agent, or Firm*—Arnold B. Silverman; David C. Jenkins; Eckert Seamans Cherin & Mellott, LLC

(57) ABSTRACT

The invention provides a height-adjustable bridging device for joints between floor coverings. The bridging device includes an upper element and a base element. The upper element includes a generally perpendicular retaining bar. The retaining bar includes a holding device. The base element also includes retaining bars which are structured to cooperate with the upper element retaining bar holding device. A support device, which includes another upper element retaining bar and a force uptake piece, such as a base element bar, is disposed on the upper element and the base element respectively. The support device aids in preventing the upper element from tipping.

18 Claims, 4 Drawing Sheets

BRIDGING ARRANGEMENT

CROSS REFERENCE TO RELATED APPLICATIONS

This application is a 371 of PCT/EP98/03 991 filed Jun. 30, 1998.

BACKGROUND OF THE INVENTION

1. Field of the Invention

The invention relates to a height-adjustable bridging device for joints between floor coverings.

2. Description of Related Art

Such height-adjustable bridging devices are used where a transition must be created between a higher and a lower floor covering, such as between a parquet floor and a rug, or between a doorsill and a floor covering at a lower level. A bridging device is also used for same-height transitions at the doorsill or as an expansion joint for subdividing larger surfaces.

Especially at locations that are subject to heavy use, it is necessary to replace a badly worn floor covering. In such a case, the bridging device should be loosened and re-used. The differing heights between such elements as a sill and an adjoining rug can be aligned by tapping on the upper element of the bridging device. However, here a danger exists that the upper element of the bridging device will tip and move aside while being tapped on.

The object of the invention, therefore, is to create a height-adjustable bridging arrangement in which a tipping moment in the upper element of the bridging device is avoided to the greatest extent possible.

The problem is solved by a bridging device having a support device configured between the upper element and the base element to prevent tipping the upper element during installation.

BRIEF SUMMARY OF THE INVENTION

The support device according to the invention advantageously consists of a support bar placed at an interval from the upper element retaining bar, which, with an absorbing mechanism, exerts a combined effect on the base element. By having the support device at an interval from the upper element support bar the support device counteracts the tipping moment created during the installation of the bridging device.

Advantageous configurations of the invention are set forth below.

BRIEF DESCRIPTION OF THE DRAWINGS

The invention is explained in greater detail in the drawings. Shown in the drawings are.

DETAILED DESCRIPTION OF THE INVENTION

Figure 1:
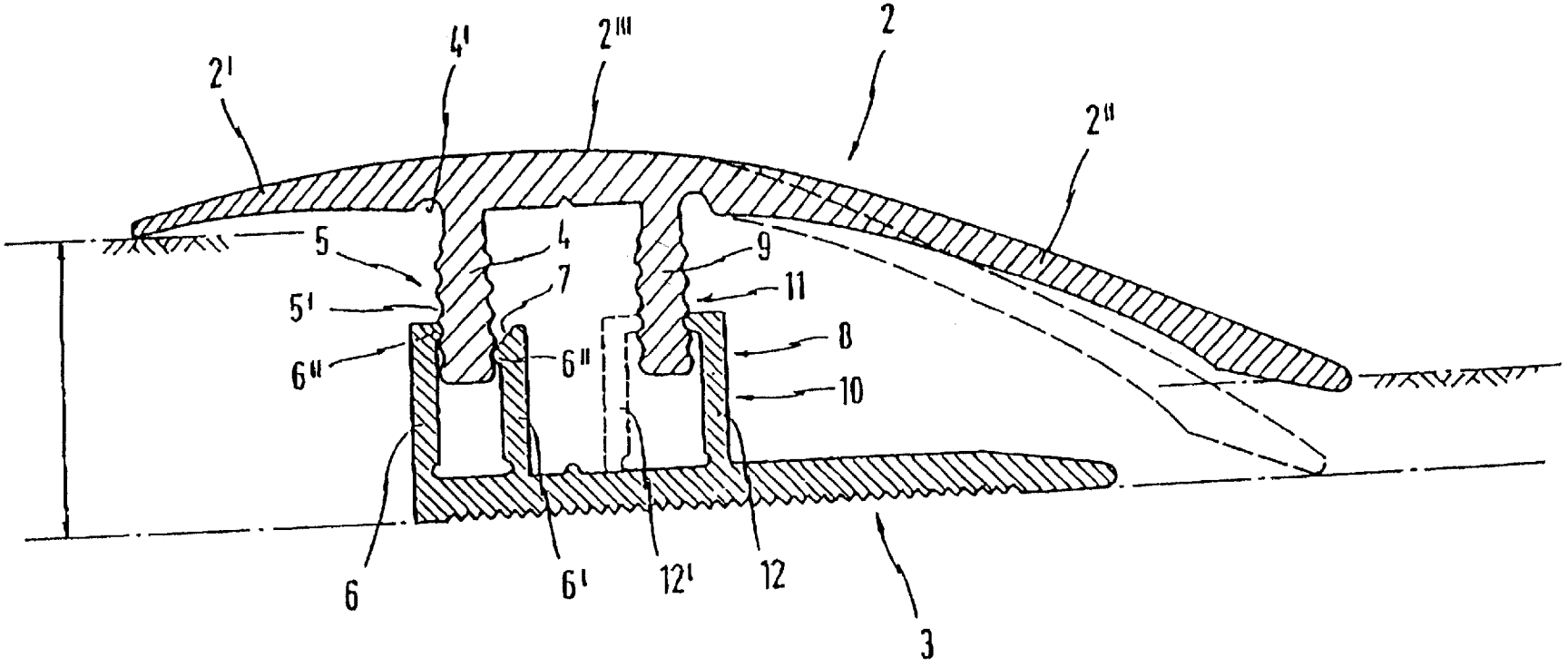
FIG. 1: a height-adapted bridging device in side view.

FIG. 1 shows the bridging device according to the invention. In essence it consists of an upper element 2 and a base element 3. In the embodiment depicted, upper element 2 has cover wings 2' and 2" of differing width, which extend to both sides of a middle section 2 "'. Beneath middle section 2" in the embodiment depicted, a retaining bar 4 is attached. In the angle between retaining bar 4 and side wing 2' a bending channel 4' is configured. Retaining bar 4 is held by two bars 6, 6' that project upward., which are attached elastically to base element 3. For holding upper element 2 to base element 3, a holding device 5, is placed both on the retaining bar 4 and, on the retaining bars 6, 6'.

In the embodiment depicted, the holding device consists of a multiplicity of grooves 5' in retaining bar 4 which essentially ran parallel in the longitudinal direction of the bridging device and which engage into projections 6" of retaining bars 6, 6'.

One particular feature is that retaining bars 6, 6' are of differing heights, with the resulting offset arrangement of retaining projections 6". This measure, and the insertion slant 7, allow retaining bar 4 to be put on with great ease.

A support device 8 is shown disposed below the wider cover wing 2". Support device 8 has a retaining bar 9 which is placed at a distance from retaining bar 4 in the transition area between the middle section 2"' and the lateral wing 2", beneath the upper element. Combined with this retaining bar 9 is a force uptake piece 10, which in the embodiment depicted is configured as a bar 12. Force transfer is accomplished through a toothed device 11 disposed on retaining bar 9.

In FIG. 1, the outlines of the wider wing 2" are depicted as both dashed and continuous. Normally the continuous-line setting is the configuration as installed. The continuous line of side wing 2" represents the delivered configuration which the upper element maintains when it is in the highest position. After installation, the blade assumes the dashed line position, which can also be designated as the lower setting. To assume this position, the upper element is beaten down in the area of bar 4 with a hammer and a wooden support (impact block). This can lead to tipping which is absorbed by the holding device. As soon as blade 2' rests on the left-side surface, the seating process is complete, with the particular thickness of the left-side surface being taken into account at all points.

Figure 2:
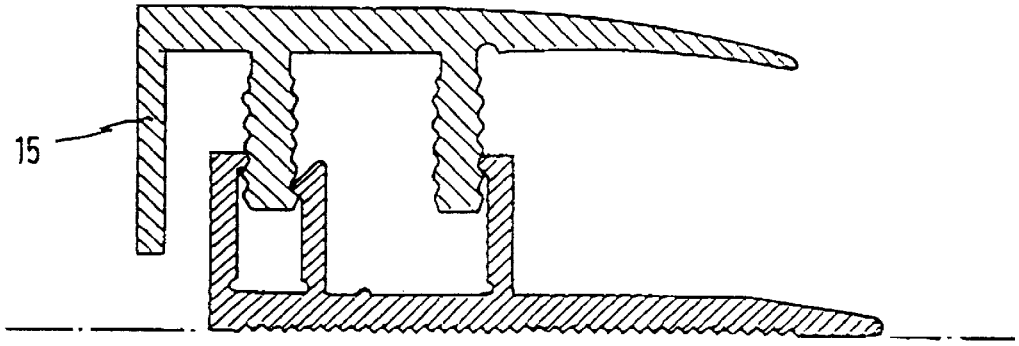
FIG. 2: a height-adapted bridging device in the invention-specific form as a wall border in the upper position.
Figure 3:
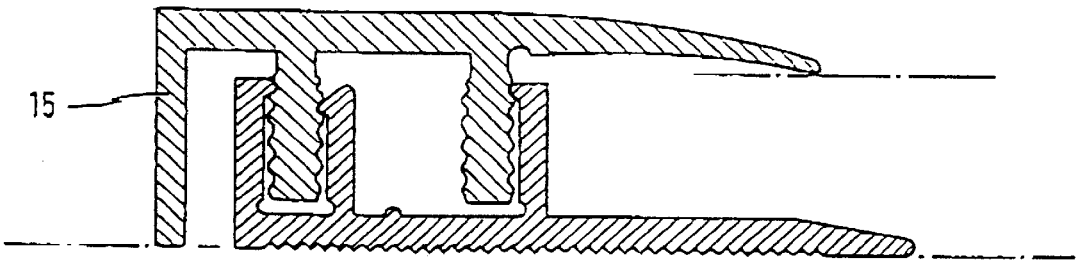
FIG. 3: the device as per FIG. 2 in the lower position.

FIGS. 2 and 3 show that the device is adjustable on floor coverings that have differing thicknesses. In FIG. 2, the uppermost position, and in FIG. 3, the lowest position, a bridging device for bordering on walls is depicted, whereby the retaining bar 15 becomes a support apparatus at the wall. In addition, however, if the bridging device is used at sills or platforms, the bridging device also serves as a cover, to largely hide from view the base element 3 which may be of a different color.

Figure 4:
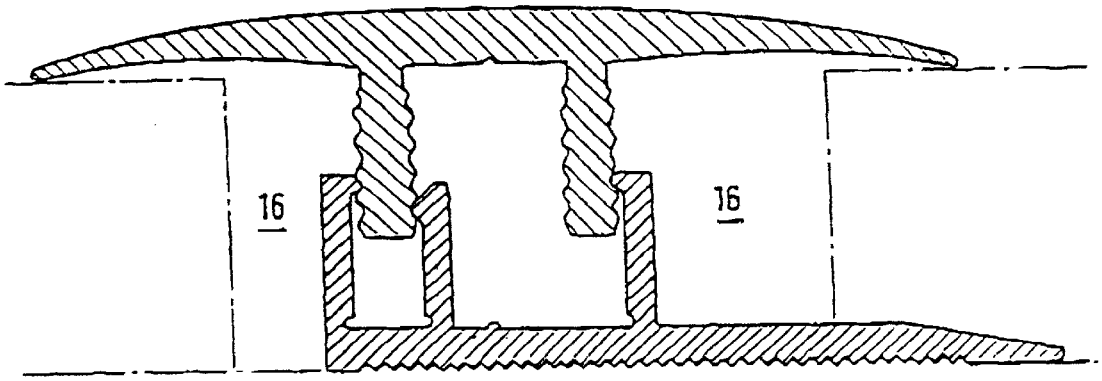
FIG. 4: a bridging device for bridging a joint between same-height floor coverings, such as laminated or parquet floors, in the upper position.
Figure 5:
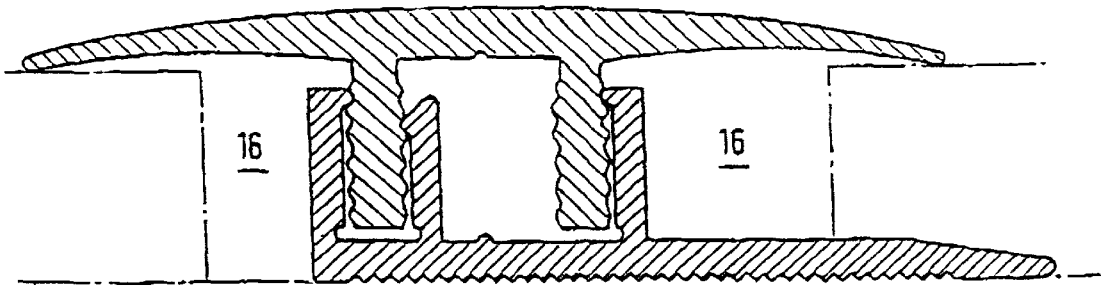
FIG. 5: the device as per FIG. 4 in the lower position

FIGS. 4 (uppermost position) and 5 (lowest position) depict a bridging device which is suited for use in joints between floor coverings at the same level, especially for bridging over expansion joints 16 in larger laminate or parquet floors.

Figure 6:
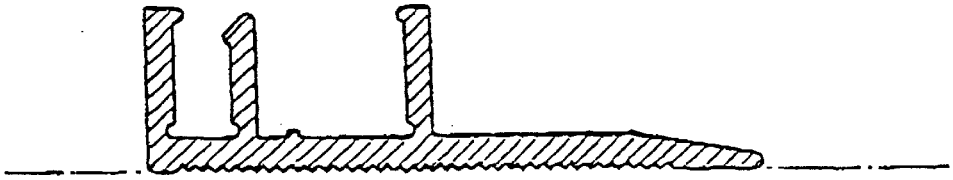
FIG. 6: a base element.
Figure 7:
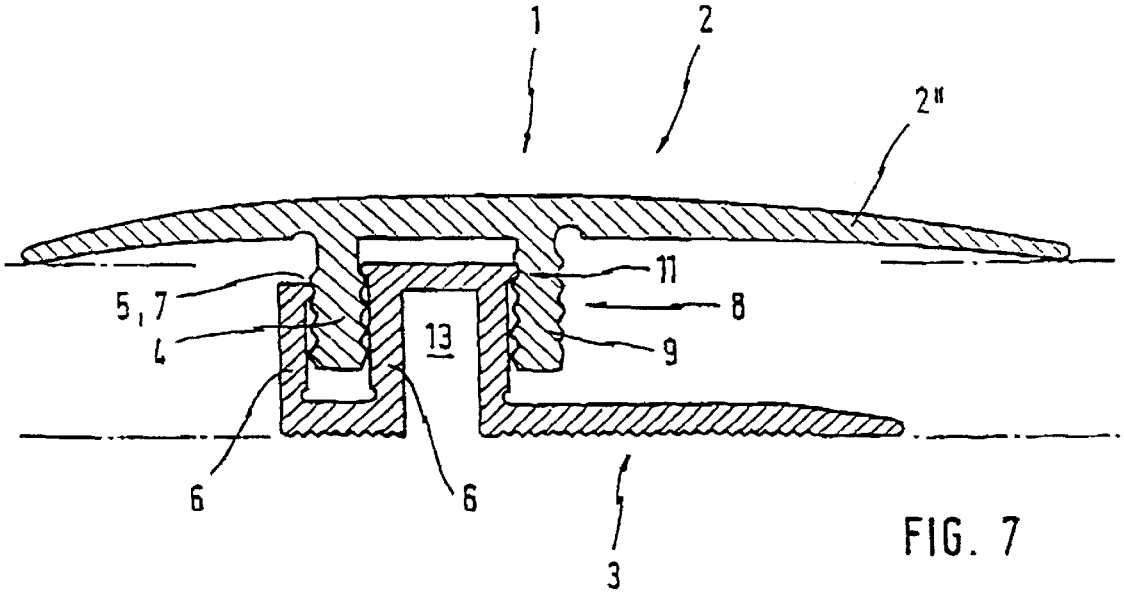
FIG. 7: bridging device according to the invention with an alternative base profile.

FIG. 6 shows a base element in detail. FIG. 7 shows a further embodiment of the bridging device according to the invention. Here, the base element 3 is equipped with a corrugated projection 13, whereby the corrugation is rectangular on each outer edge of the corrugation, provision has been made of projections for the holding devices or toothed devices 11 for the support device. In one such base element, a supporting moment is provided when the longer cover wing 2" is hammered downward, as is required in certain joint configurations.

Provision can also be made in the implementation according to FIG. 1 to place the bar 12' not on the side as shown, but on the other side of bar 9 as shown by ghost image 12'. The depiction in the drawing is configured for laminated floors with thicknesses between 6 and 11 mm; the same principle holds true for parquet floors between 11 and 16 mm thick. Only where the height differences to be bridged are greater are these devices designed to be larger.

What is claimed is:

1. A height-adjustable bridging device (1) for joints between floor coverings, said bridging device consisting of an upper element (2) and a base element (3), said upper element (2) having at least one upper retaining bar (4) which is provided with a holding device said holding device configured on said retaining bar bilaterally, and said base element having two upwardly projecting retaining bars (6, 6') with holding devices that complement the upper element retaining bar holding device, said base element retaining bars structured to embrace said upper element retaining bar (4) bilaterally on said upper element retaining bar holding device; and a support device (8) with a support bar (9) which prevents tipping between upper element (2) and base element (3), the support bar (9) operates jointly with a force uptake piece (10) extending upwardly from said base placed at an interval from retaining bars (6, 6') on base element (3).

2. The bridging device according to claim 1, where said support bar (9) has a toothed device (11) disposed thereon, said toothed device structured to cooperate with force uptake piece (10).

3. The bridging device according to claim 1 or 2, wherein said force uptake piece (10) is an upwardly projecting bar (12) placed on base element (3).

4. The bridging device according to claim 1 or 2, wherein said force uptake piece (10) is a corrugation projection (13) on said base element (3).

5. The bridging device according to claim 1 wherein said force uptake piece (10) is placed on the side of said upper element support bar (9) adjacent to said upper member retaining bar.

6. The bridging device according to claim 1, wherein said base element retaining bars (6, 6') are of differing heights.

7. The bridging device according to claim 1 wherein the base element retaining bar (6') which faces said upper element support bar (9) is lower than the opposite base element retaining bar (6).

8. The bridging device according to claim 2 wherein said force uptake piece (10) is placed on the side of said upper element support bar (9) adjacent to said upper element retaining bar.

9. The bridging device according to claim 2, wherein said base element retaining bars (6, 6') are of differing heights.

10. The bridging device according to claim 2 wherein the base element retaining bar (6') which faces said upper element support bar (9) is lower than the opposite base element retaining bar (6).

11. The bridging device according to claim 3 wherein said force uptake piece (10) is placed on the side of said upper element support bar (9) adjacent to said upper element retaining bar.

12. The bridging device according to claim 3, wherein said base element retaining bars (6, 6') are of differing heights.

13. The bridging device according to claim 3 wherein the base element retaining bar (6') which faces said upper element support bar (9) is lower than the opposite base element retaining bar (6).

14. The bridging device according to claim 4 wherein said force uptake piece (10) is placed on the side of said upper element support bar (9) adjacent to said upper element retaining bar.

15. The bridging device according to claim 14, wherein said base element retaining bars (6, 6') are of differing heights.

16. The bridging device according to claim 15 wherein the base element retaining bar (6') which faces said upper element support bar (9) is lower than the opposite base element retaining bar (6).

17. The bridging device according to claim 4, wherein said base element retaining bars (6, 6') are of differing heights.

18. The bridging device according to claim 4 wherein the base element retaining bar (6') which faces said upper element support bar (9) is lower than the opposite base element retaining bar (6).

* * * * *

UNITED STATES PATENT AND TRADEMARK OFFICE

CERTIFICATE OF CORRECTION

PATENT NO. : 6,345,480 B1
DATED : February 12, 2002
INVENTOR(S) : Hans A. Kemper et al.

It is certified that error appears in the above-identified patent and that said Letters Patent is hereby corrected as shown below:

Title page,
FOREIGN PATENT DOCUMENTS, "9600057" should read -- 29600057 --; and "4/1986" should read -- 3/1996 --.

Column 2,
Line 7, delete the "." after upward.
Line 9, after "device 5", insert -- , including a plurality of grooves 5' and projections 6" --.

Column 3,
Line 14, insert a -- ; -- after "device".
Line 23, after "(9)", insert -- extending downwardly from said upper element --.

Signed and Sealed this

Seventeenth Day of September, 2002

*Attest:*

*Attesting Officer*

JAMES E. ROGAN
*Director of the United States Patent and Trademark Office*